United States Patent [19]

Brock et al.

[11] 3,930,461

[45] Jan. 6, 1976

[54] APPARATUS FOR PIVOTALLY MOUNTING AN OUTBOARD FISHING MOTOR

[75] Inventors: John O. Brock; Marmion Dean Davis; James Robert Wray, all of Shelby, N.C.

[73] Assignee: Interstate Industries, Inc., Shelby, N.C.

[22] Filed: Mar. 27, 1975

[21] Appl. No.: 562,596

[52] U.S. Cl. ..... 115/41 R; 115/17; 115/18 E; 248/4

[51] Int. Cl.[2] ..... B63H 21/26

[58] Field of Search ..... 115/17, 41 R, 18 E; 248/4; 114/210

[56] References Cited

UNITED STATES PATENTS

| | | | |
|---|---|---|---|
| 3,750,617 | 8/1973 | Pinkerton | 115/41 R |
| 3,865,335 | 2/1975 | Roller et al. | 115/17 |
| 3,874,318 | 4/1975 | Langley | 115/41 R |

*Primary Examiner*—Trygve M. Blix
*Assistant Examiner*—Stuart M. Goldstein
*Attorney, Agent, or Firm*—Parrott, Bell, Seltzer, Park & Gibson

[57] ABSTRACT

An apparatus for pivotally mounting an outboard fishing motor, such as a shaft-mounted submersible electric motor, on the bow of a fishing boat or the like for pivotal movement between an operative position wherein the motor is held in the water and a non-operative raised position. The apparatus comprises a pivotally mounted bracket for supporting the shaft of the motor, a semi-circular guide member fixedly positioned adjacent the bracket, a follower interconnecting the bracket and guide member, and a power control system including a reversible electric motor and cable arrangement for automatically and positively pivoting the fishing motor in either direction between its operative and non-operative positions by translating the follower along the guide member.

10 Claims, 6 Drawing Figures

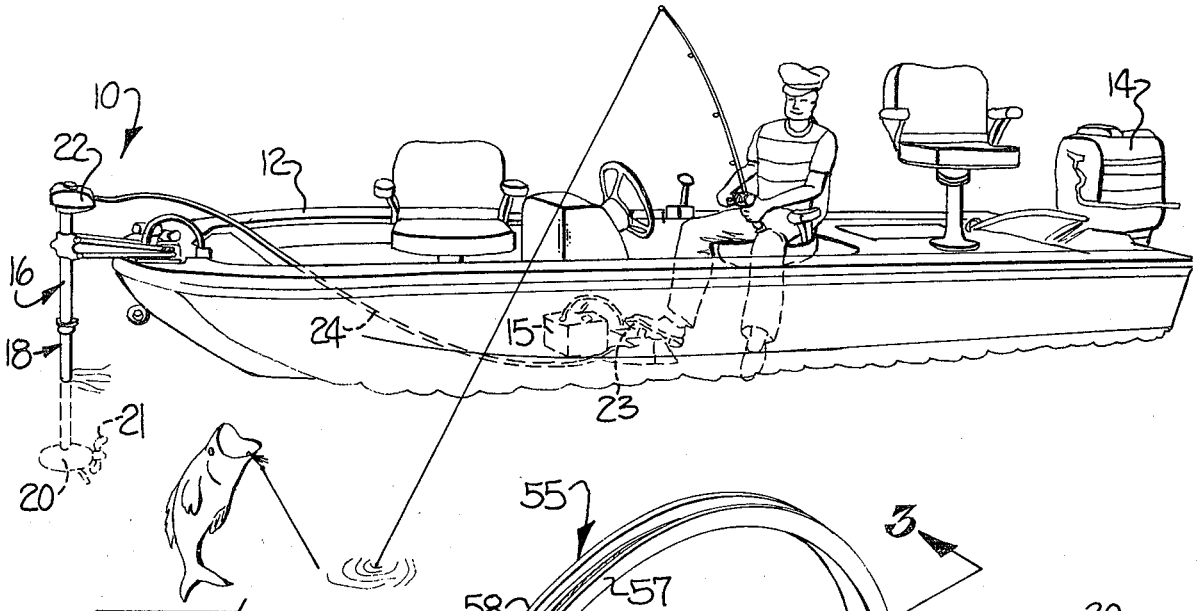
Fig-1
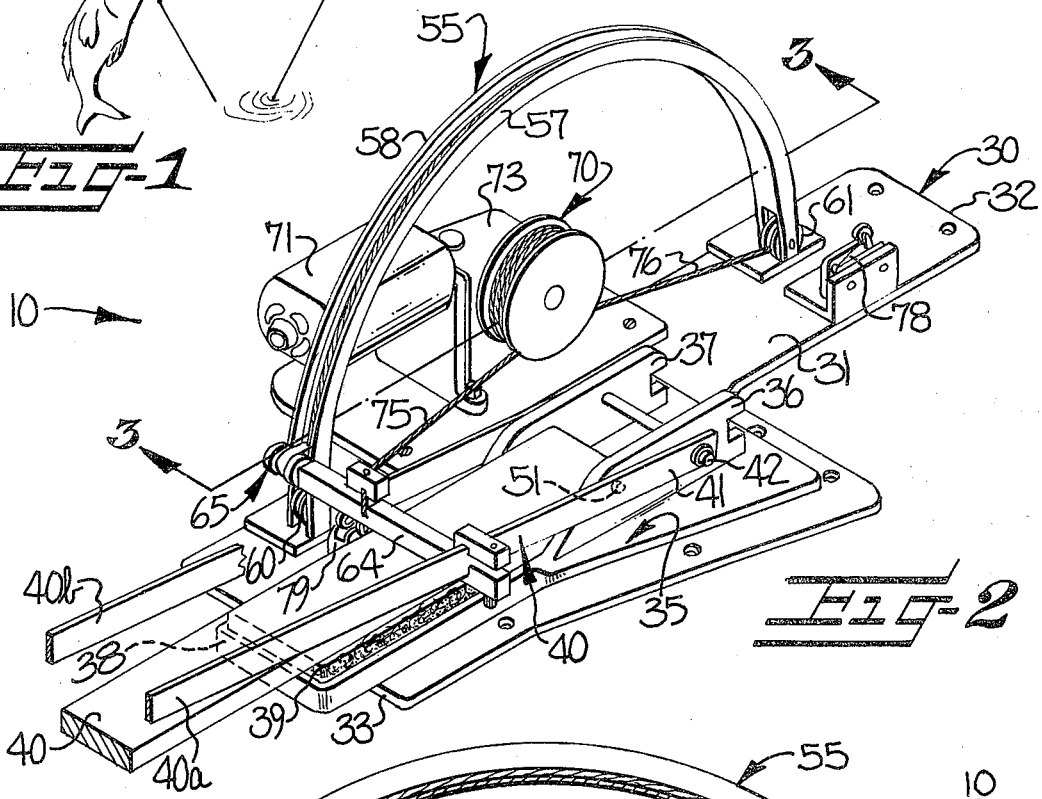
Fig-2
Fig-3
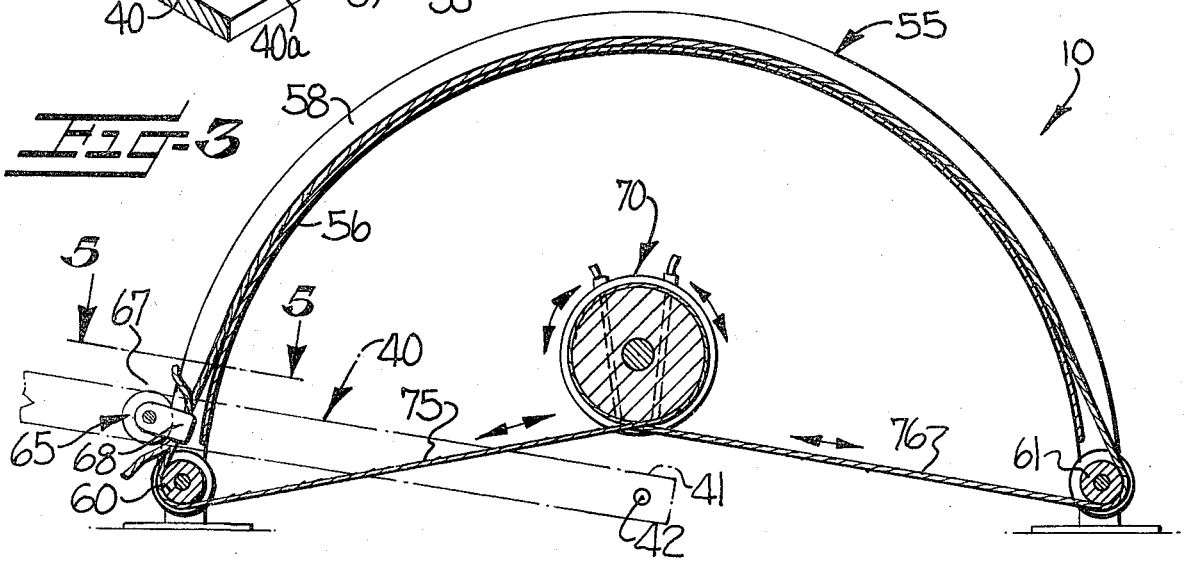

APPARATUS FOR PIVOTALLY MOUNTING AN OUTBOARD FISHING MOTOR

The present invention relates to a powered apparatus for automatically pivoting an outboard fishing motor between a lowered operative position wherein the motor is held in the water, and a raised non-operative position wherein the motor is removed from the water.

It is known to mount a small auxiliary motor on the bow of a fishing boat for use while trolling. Typically, the motor is a shaft-mounted electric motor, and comprises an elongated shaft having a submersible electric motor and propeller mounted at the lower end thereof, and a steering handle or the like mounted at the upper end of the shaft. The motor is powered by a suitable battery carried in the boat, and a speed control rheostat may also be provided for controlling the speed of the motor and thus the speed of the boat through the water.

It has also been proposed to pivotally mount a motor of the described type on the bow to permit the motor to be retracted from the water in the event the fishing lines become snagged, or if it is desired to move the boat under full power from the main motor. In this regard, various pivotal mounting brackets have been developed and marketed, and wherein the boat operator manually raises and lowers the motor between its operative and non-operative positions, note for example the patent to Ibbs, U.S. Pat. No. 3,245,640.

The above manual raising and lowering operations can easily become tiring and aggravating, particularly when it is realized that the boat operator normally is positioned in the middle or at the stern of the boat while fishing, and he must therefore move to the front of the boat each time the motor is to be raised or lowered. In this regard, various rope arrangements have been proposed for permitting the operator to raise or lower the motor while he is located at the middle or stern of the boat, but such ropes tend to become snagged in the fishing lines and other boat equipment, and thus they have not been entirely satisfactory. Further, the electric outboard motor is often of considerable size and weight, making the lifting and lowering operations physically difficult.

It is accordingly an object of the present invention to provide an apparatus for pivoting a relatively large and heavy outboard fishing motor between its operative and non-operative positions and which avoids the above noted problems associated with the presently known devices.

It is another object of the present invention to provide a powered apparatus for selectively pivoting an outboard fishing motor, such as a shaft-mounted submersible electric motor, between a lowered position wherein the motor is operatively held in the water and a raised position wherein the motor is removed from the water, and wherein the power required to pivot the motor is minimized.

It is a further object of the present invention to provide an apparatus of the described type which may be remotely controlled by the boat operator, and which automatically terminates its operation upon the motor reaching either the operative or the non-operative position.

It is still another object of the present invention to provide an apparatus of the described type which pivots the motor under controlled conditions in both directions, and which is essentially locked in its operative position to thereby preclude the motor from lifting from the water during operation.

These and other objects and advantages of the present invention are achieved in the embodiment illustrated herein by the provision of an apparatus which comprises a mounting frame adapted to be fixedly attached to the bow of the boat, a bracket pivotally carried by the mounting frame and being pivotable between a forward position wherein the bracket horizontally overlies the outer end of the frame and a retracted position, means carried at the remote free end of the bracket for attaching the shaft of an outboard motor thereto, a semi-circular guide member fixedly positioned adjacent the bracket, a follower carried by the bracket and positioned to contact the guide member, and power means for selectively and positively translating the follower in either direction along the guide member to thereby pivot the bracket between its forward and retracted positions. In the illustrated embodiment, this power means takes the form of a drive wheel rotatably carried by the frame, an electric motor for selectively rotating the drive wheel in either direction, and a cable wound about the drive wheel and guided for movement along the guide member and operatively connected to the follower such that operation of the motor in one direction serves to translate the follower in a predetermined direction to pivot the bracket toward its retracted position and operation of the motor in the opposite direction serves to translate the follower in the opposite direction and pivot the bracket toward its forward position. A manually operable switch may be provided for selectively operating the motor in either direction, and limit switches may also be provided for terminating operation of the motor upon reaching either its operative or non-operative position.

As will be understood, the force acting through the cable to translate the follower acts directly perpendicular to the bracket through its full pivotal movement, and the power requirement for pivoting the bracket and motor is thereby minimized.

Some of the objects and advantages of the invention having been stated, others will appear as the description proceeds when taken in connection with the accompanying drawings, in which FIG. 1 is a perspective environmental view illustrating an apparatus embodying the features of the present invention and the manner in which the apparatus may be mounted on a conventional fishing boat;

FIG. 2 is an enlarged perspective view, partly broken away, of the apparatus shown in FIG. 1, and which illustrates the bracket in its forward position;

FIG. 3 is a fragmentary side elevation view, and illustrating the semi-circular guide member and cable arrangement for pivoting the bracket;

Figures 4, 5, 6:
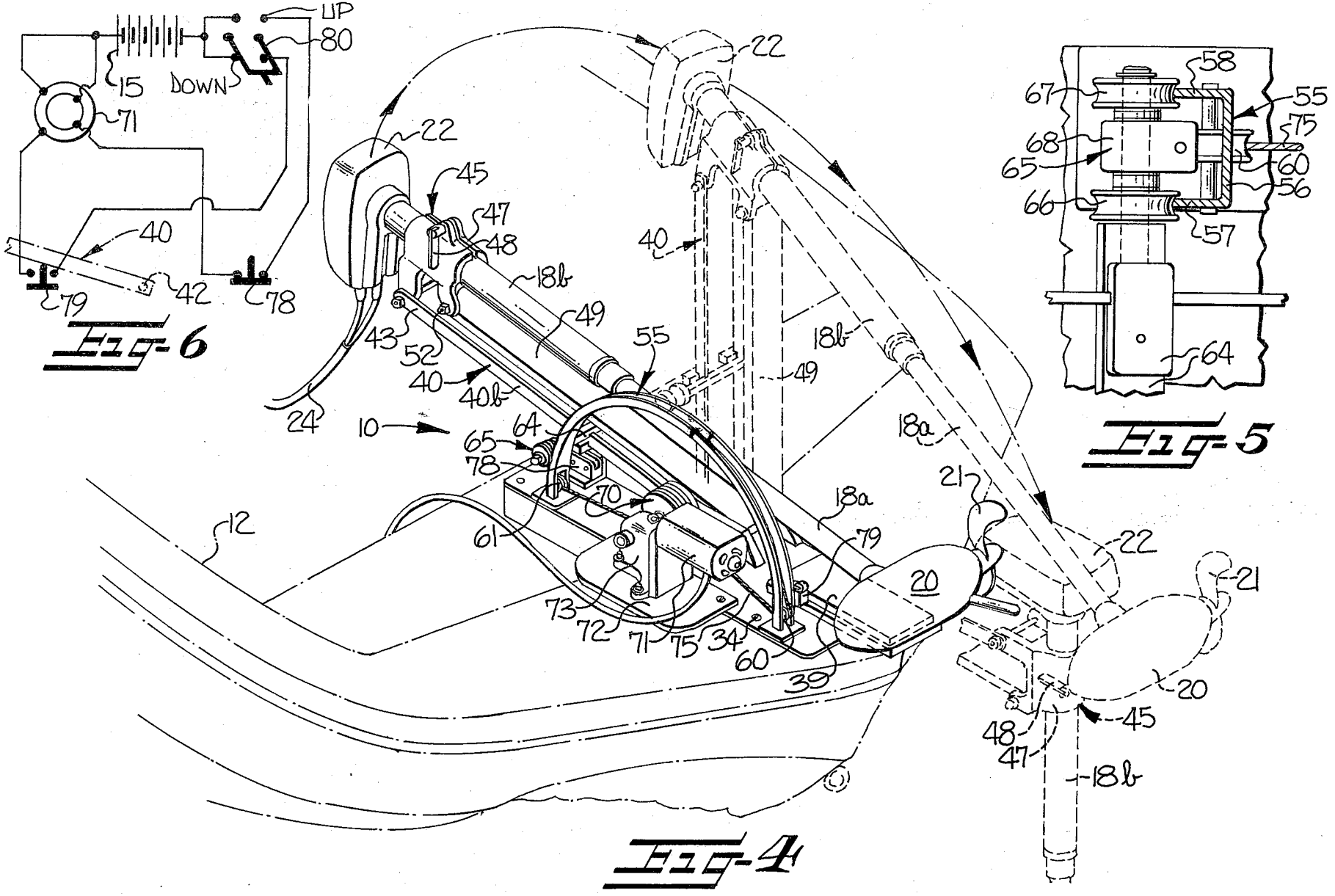
FIG. 4 is a perspective view of the apparatus and supported motor in its retracted position and further showing, in dashed lines, the apparatus and motor in an intermediate and a forward position.
FIG. 5 is a fragmentary plan view taken substantially along the line 5—5 of FIG. 3.
FIG. 6 is a schematic wiring diagram of the power control system for the apparatus of the present invention.

Referring more particularly to the drawings, an apparatus embodying the features of the present invention is indicated generally at 10, and is shown as being attached to the bow of a conventional fishing boat 12.

The boat 12 also includes a conventional internal combustion outboard motor 14 mounted at the stern for powering the boat at relatively high speeds in the normal manner. Also, a battery 15, such as a twelve volt automotive battery, may be positioned in the boat for the purposes described below.

In accordance with the present invention, the apparatus 10 is adapted to pivotally mount an auxiliary outboard motor 16 for movement between the operative position shown in FIGS. 1 and 2, and the non-operative position shown in solid lines in FIG. 4. The illustrated motor 16 is conventional, and comprises an elongated shaft 18 having a submersible electric motor 20 and propeller 21 carried at the lower end thereof. An automatic steering control system is also provided which comprises a housing 22 carried at the upper end of the shaft and a foot pedal 23 positioned within the boat and adjacent the operator. The housing and foot pedal are interconnected by a suitable cable arrangement 24 such that movement of the pedal is adapted to pivot the motor in either direction about the axis of the shaft 18 to effect steering thereof.

The shaft 18 comprises an inner tubular member 18a and a coaxial outer sleeve 18b which are relatively rotatable about their common axis. The inner tubular member **18*a* is directly connected between the steering control system in the housing 22 and the motor 20 to permit steering of the motor in the manner described above, and with the sleeve 18*b* being held stationary. An electric cord (not shown) extends upwardly through the shaft 18 and along the cable 24, and is operatively connected to the battery 15 for powering the motor 20. Also, a suitable switch and rheostat (not shown) may be positioned adjacent the foot pedal for selectively controlling the operation and speed for the motor 20**.

The apparatus 10 comprises a mounting frame 30 which includes a generally flat plate 31 which defines an inner end 32 facing the interior of the boat and an outer end 33 which extends to a point immediately adjacent the bow of the boat. The plate 31 is secured to the bow by any suitable arrangement, such as by screws 34, and it assumes a generally horizontal orientation.

The mounting frame 30 further includes a generally flat support plate 35 overlying and secured, as by welding, to the outer end portion of the plate 31. The overlying plate 35 includes a pair of integral, spaced apart angle braces 36, 37, and a forward end 38 which is adapted to extend somewhat beyond the outer end 33 of the plate 31 and beyond the bow of the boat. A resilient support pad 39 of rubber or the like is positioned to rest upon the forward end 38 of the plate 35 for the purposes to become apparent.

The angle braces 36, 37 are aligned with the longitudinal axis of the boat 12, and together pivotally mount a bracket 40 to the mounting frame 30. More particularly, the bracket comprises two spaced parallel arms **40*a*, 40*b*, each of which includes one end 41 mounted for pivotal movement about the pin 42, and a remote free end 43. The pin 42 extends transversely between the braces 36, 37 to define a first horizontal axis which is positioned at a medial point between the ends of the mounting plate 31**.

The bracket 40 is accordingly pivotable between a forward position (FIGS. 1 and 2) wherein the bracket horizontally overlies the outer end portion of the mounting plate 31, and a retracted position (FIG. 4) wherein the bracket is disposed substantially 180° from its forward position and overlies the inner end portion of the plate 31. In this regard, it will be noted that the bracket 40 is of a length such that the remote free end 43 of each arm extends well beyond the forward end 38 of the plate 35 when the bracket is positioned in its forward position.

The bracket 40 also carries means generally indicated at 45 for releasably attaching the shaft 18 of the outboard motor 16 thereto. More particularly, the shaft attaching means 45 comprises a split, tubular clamping member 47 adapted to receive the shaft 18 and be releasably secured to the sleeve **18*b* by means of a hand operated set screw 48. The clamping member 47 is pivotally connected to each of the arms of the bracket 40 at the free ends 43 so as to be pivotal about a transverse horizontal axis which is parallel to the axis of pin 42**.

The orientation of the clamping member during the pivotal movement of the bracket is controlled by means of a lever arm 49 which has one end pivotally connected between the angle brackets of the frame at 51, and an opposite end pivotally connected to the clamping member at 52. The pivotal axes defined at 51 and 52 are each parallel to the axis of the pin 42, and by design, the clamping member 47 is held substantially perpendicular to the bracket 40 when the bracket occupies its forward position, and it is pivoted through about 90 degrees during movement of the bracket between its forward and retracted positions, note FIG. 4. Thus the shaft 18 of the motor 16 is held substantially vertically in front of the bow when the bracket is in its forward position, and it is held substantially horizontally when the bracket is in its retracted position. Also, it will be noted that the motor 20 is adapted to rest upon the pad 39 in the retracted position to thereby relieve the stress in the shaft 18 and to prevent damage to the motor 20 during movement of the boat.

The depth to which the motor 20 is disposed in the water may be controlled by releasing the set screw 48 to open the clamping member 47, and then sliding the shaft 18 axially to its desired position. Upon tightening of the set screw, the clamping member is fixedly secured to the outer sleeve **18*b* of the shaft, but steering is permitted in view of the relative rotation between the outer sleeve and inner tubular member 18*a*** of the shaft as described above.

The above described bracket 40, lever arm 49, and clamping member 47 are similar to the presently known manually operable pivoting devices, and thus do not per se form a part of the present invention.

In order to positively pivot the bracket between its forward and retracted positions, there is provided an arcuately curved, semi-circular guide member 55 which is fixedly carried by the frame immediately adjacent the bracket 40. The guide member 55 defines a segment of a circle having its center located along the pivotal horizontal axis defined by the pin 42. Also, the guide member is disposed in a plane which lies parallel to the plane defined by the pivotal movement of the bracket 40, and it extends along substantially the full length of the arc defined by the pivotal movement of the bracket between its forward and retracted positions.

As best seen in FIGS. 2 and 3, the guide member 55 is of U-shaped cross sectional configuration to define a bottom wall 56 and upstanding spaced side walls 57, 58. In addition, a pair of guide pulleys 60, 61 are rotatably carried by the frame 30, with each pulley being mounted adjacent one end of the guide member, note FIG. 3.

A transversely directed linkage 64 is connected between the two arms of the bracket 40 and at a medial point along the length of the bracket, the linkage extending transversely beyond the arm 40*b* to a point immediately adjacent the guide member 55. A follower 65 is rotatably carried at the end of the linkage 64, and is positioned to contact and follow the guide member 55 during the pivotal movement of the bracket, note FIG. 5. In this regard, the follower 65 comprises a pair of spaced rollers 66, 67 with a mounting tab 68 positioned therebetween. Each of the rollers has a channeled circumferential trackway, and is positioned to overlie one of the side walls 57, 58 of the guide member such that each side wall is partially received in the associated trackway to thereby substantially preclude relative transverse movement between the follower 65 and guide member 55.

A power system is provided for selectively translating the follower 65 in either direction along the guide member 55 to thereby pivot the bracket between its forward and retracted positions. More particularly, the power system comprises a drive wheel 70 carried by the frame 30 for rotation about a fixed axis which is disposed parallel to the horizontal axis of the pin 42 and generally within the arc defined by the guide member 55. A reversible electric motor 71 is also mounted to the frame 30 by means of the support plate 72, and acts through a gear reduction box 73 to rotate the drive wheel 70 in either direction. The motor 71 is operatively connected to and powered by the battery 15 in the manner further described below.

In accordance with the illustrated embodiment of the present invention, a pair of cable segments 75, 76 operatively interconnect the drive wheel 70 and the mounting tab 68 of the follower 65, whereby the bracket 40 may be pivoted from its forward position to its retracted position upon rotation of the drive wheel in a first direction, and the bracket may be reversely pivoted upon rotation of the drive wheel in the opposite direction. More particularly, a first cable segment 75 has one end thereof fixed to the drive wheel 70 and wound thereabout in a clockwise direction as seen in FIGS. 2 and 3. The other end of the segment 75 is entrained about the guide pulley 60, and extends along the guide member 55 and is attached to the tab 68 of the follower 65.

The second cable segment 76 has one end fixed to the drive wheel 70 and is wound thereabout in a counterclockwise direction as seen in FIGS. 2 and 3. The other end of the segment 76 is entrained about the pulley 61, and extends along the guide member 55 and is attached to the tab 68 from the opposite direction. Thus rotation of the drive wheel 70 in a clockwise direction acts to cause the follower to be drawn along the arcuate curvature of the guide member and positively pivot the bracket from its forward to its retracted position. Counterclockwise rotation of the drive wheel acts to draw the follower in the opposite direction and positively pivot the bracket from its retracted to its forward position. In this regard, it will be noted that the force acting upon the follower 65 from the cable segments during the pivotal movement extends in a direction perpendicular to the bracket through the full movement of the bracket between its forward and retracted positions, to thereby minimize the power requirement of the electric motor 71.

A pair of limit switches 78, 79 are carried by the plate 31, with the switch 78 being positioned adjacent the inner end 32, and the switch 79 being positioned adjacent the outer end 33. The switch 78 is engaged by the bracket 40 upon reaching its retracted position, and the switch 79 is engaged by the bracket upon reaching its forward position, to terminate operation of the motor 71, note FIG. 6. Also, a manually operable control switch 80 is provided for selectively operating the motor 71 in either direction. Typically, the switch 80 is positioned adjacent the foot pedal 23 so as to be conveniently controlled by the operator of the boat.

As will be apparent from the above description, the reduction gear box 73 serves to resist inadvertent rotation of the drive wheel 70 caused by tension in the cable segments, and thus it resists inadvertent movement of the bracket and thereby serves to effectively retain the bracket 40 and motor 16 in a desired position and in particular, to preclude the motor 16 from lifting from the water during operation. Also, while the means for interconnecting the drive wheel 70 and follower 65 has been described above as comprising two cable segments each having an end secured to the circumference of the drive wheel, it will be understood that the cable segments could comprise a unitary cable which is wound about the drive wheel a number of times without being fixedly connected thereto. This latter arrangement has the advantage of serving as a slip-clutch between the drive wheel and follower in the event an obstruction is encountered in the pivotal movement of the bracket and motor.

In use, the operator initially mounts the motor 16 at the free end of the bracket 40 by locking the clamping member 47 about the sleeve 18*b* of the shaft 18 in the manner described above. Assuming the bracket is in its retracted position as seen in solid lines in FIG. 4, the motor 16 may be brought into its operative position by the boat operator closing the switch 80 into its "down" position. The motor 71 is thereby energized to rotate the drive wheel 70 counterclockwise as seen in FIGS. 2 and 3 and such that the first cable segment 75 pulls forwardly and upwardly upon the follower 65 and in a direction perpendicular to the bracket to thereby draw the follower along the guide member and pivot the bracket 40 in a counterclockwise direction about the axis defined by the pin 42. As will be understood, the counterclockwise rotation of the drive wheel 70 also unwinds a sufficient length of the second cable segment 76 to permit the described pivotal movement of the bracket and motor 16 to proceed under controlled movement. In other words, the second cable segment 76 serves to prevent the sudden dropping of the bracket and motor after the center of gravity passes over the axis of the pin 42. Upon the bracket 40 reaching its fully lowered or forward position as seen in FIGS. 2 and 6, the bracket 40 engages and opens the limit switch 79 to automatically terminate operation of the motor 71.

When it is desired to retract the motor 16, the operator closes the switch 80 into its "up" position, thereby causing the motor 71 and drive wheel 70 to rotate clockwise as seen in FIGS. 2 and 3. The second cable segment 76 thus pulls upwardly and inwardly on the follower 65, causing the bracket to pivot rearwardly about the axis of the pin 42. Such rotation continues until the bracket contacts and opens the limit switch 78, which is predetermined to occur when the bracket reaches its retracted position.

In the drawings and specification, there has been set forth a preferred embodiment of the invention, and although specific terms are employed, they are used in a generic and descriptive sense only and not for purposes of limitation.

That which is claimed is:

1. An apparatus for pivotally mounting an outboard motor, such as a shaft-mounted submersible electric motor, on a fishing boat or the like and such that the motor may be selectively pivoted between a vertically disposed operative position in the water and a horizontally disposed raised position removed from the water, said apparatus comprising, a mounting frame adapted to be fixedly attached to a boat so as to extend in a generally horizontal direction, a bracket having one end thereof pivotally connected to said frame for rotation about a pivotal horizontal axis, and a remote free end, said bracket being pivotable between a forward position wherein said bracket horizontally overlies said outer end of said frame and a retracted position, and said bracket being of a length such that said remote free end extends beyond said outer end of said frame when said bracket is positioned in said forward position, means carried at said remote free end of said bracket for attaching the shaft of an outboard motor thereto, an arcuately curved guide member fixedly carried by said frame immediately adjacent said bracket and defining a segment of a circle having its center located along said pivotal horizontal axis, said segment having an arcuate length which at least corresponds to the arc defined by the pivotal movement of said bracket between said forward and retracted positions, a follower fixedly carried by said bracket intermediate the ends thereof and being positioned to contact said guide member during the pivotal movement of said bracket, and power means for selectively translating said follower in either direction along said guide member to thereby pivot said bracket between said forward position and said retracted position.

2. The apparatus as defined in claim 1 wherein said power means comprises a reversible electric motor, a cable operatively connected to said electric motor, means for guiding said cable for movement along said curved guide member, and means for interconnecting said cable and follower, whereby the force acting upon said follower extends in a direction perpendicular to said bracket through full movement of said bracket between said forward and retracted positions to thereby minimize the power requirement of said electric motor.

3. The apparatus as defined in claim 2 wherein said retracted position of said bracket is disposed about 180° from said forward position, and wherein said guide member is curved through an arc of about 180 degrees.

4. The apparatus as defined in claim 3 wherein said shaft attaching means comprises a releasable clamp, and said apparatus further comprises means for automatically pivoting said shaft attaching means through about 90° during movement of said bracket between said forward and retracted positions.

5. An apparatus for pivotally mounting an outboard motor, such as a shaft-mounted submersible electric motor, on a fishing boat or the like and such that the motor may be selectively and remotely pivoted between a vertically disposed operative position in the water and a horizontally disposed raised position removed from the water, said apparatus comprising, a mounting frame adapted to be fixedly attached to a boat so as to extend in a generally horizontal direction, and defining an inner end and an outer end, a bracket having one end thereof pivotally connected to said frame for rotation about a pivotal horizontal axis positioned at a point intermediate the ends of said frame, and a remote free end, said bracket being pivotable between a forward position wherein said bracket horizontally overlies said outer end of said frame and a retracted position disposed about 180° from said forward position and wherein said bracket overlies said inner end of said frame, and said bracket being of a length such that said remote free end extends beyond said outer end of said frame when said bracket is positioned in said forward position, means carried at said remote free end of said bracket for attaching the shaft of an outboard motor thereto, an arcuately curved guide member fixedly carried by said frame immediately adjacent said bracket and defining a semi-circle having its center located along said horizontal bracket pivot, a follower fixedly carried by said bracket intermediate the ends thereof and being positioned to contact said guide member during the pivotal movement of said bracket, power means for selectively and positively pivoting said bracket in either direction between said forward and retracted positions, and including a. a reversible electric motor, b. cable means entrained for movement along said guide member, said cable means being fixedly attached to said follower, c. means operatively interconnecting said electric motor and said cable means whereby operation of said motor in one direction moves said cable means and follower in a first direction along said guide member to pivot said bracket from said forward position to said retracted position, and operation of said motor in the opposite direction serves to move said cable means and follower in the opposite direction along said guide member to pivot said bracket from said retracted position to said forward position, and d. manually operable switch means for selectively operating said motor in either direction.

6. The apparatus as defined in claim 5 wherein said shaft attaching means includes a releasable clamp, said clamp being pivotally connected to said bracket, and said apparatus further includes a lever arm having one end pivotally connected to said frame and an opposite end pivotally connected to said clamp and such that said clamp is rotated through about 90 degrees during pivotal movement of said bracket between said forward and retracted positions and the shaft of the motor is mounted in a vertically disposed position when said bracket is in said forward position and in a horizontally disposed position when said bracket is in said retracted position.

7. The apparatus as defined in claim 6 wherein said means operatively interconnecting said electric motor and cable means comprises a drive wheel carried by said frame for rotation about a fixed axis disposed parallel to said horizontal axis of said bracket and generally within the arc defined by said guide member, said cable means being operatively entrained about said drive wheel.

8. The apparatus as defined in claim 7 wherein said guide member is of a U-shaped cross sectional configuration to define a bottom wall and spaced side walls, and further comprises a guide pulley adjacent each end thereof and such that said cable means is entrained about each of said guide pulleys and along said bottom wall of said guide member.

9. The apparatus as defined in claim 8 wherein said power means further comprises a limit switch positioned adjacent each end of said mounting frame for terminating operation of said electric motor, and wherein one switch is engaged by said bracket upon reaching said forward position and the other switch is engaged by said frame upon reaching said retracted position.

10. The apparatus as defined in claim 9 wherein said follower comprises a pair of spaced rollers, with one of said rollers overlying each of said side walls of said guide member and each of said rollers having a channeled circumferential trackway for partially receiving the associated side wall therein to thereby substantially preclude lateral movement between said follower and guide member.

* * * * *